US007935398B2

(12) United States Patent
Park et al.

(10) Patent No.: US 7,935,398 B2
(45) Date of Patent: May 3, 2011

(54) INKJET RECORDING MEDIUM

(75) Inventors: Chang Park, Sungnam-si (KR); Xulong Fu, San Diego, CA (US); Kelly Ronk, San Diego, CA (US); Ronald J Selensky, Poway, CA (US); Christine E Steichen, Escondido, CA (US); Gail Fisher, San Diego, CA (US); Dilip Patel, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1125 days.

(21) Appl. No.: 11/650,377

(22) Filed: Jan. 4, 2007

(65) Prior Publication Data

US 2008/0166507 A1 Jul. 10, 2008

(51) Int. Cl.
*B41M 5/50* (2006.01)

(52) U.S. Cl. ..... 428/32.24; 428/32.25

(58) Field of Classification Search ..... None
See application file for complete search history.

(56) References Cited

U.S. PATENT DOCUMENTS

| | | | | |
|---|---|---|---|---|
| 5,314,713 | A | 5/1994 | Mori et al. | |
| 5,677,067 | A | 10/1997 | Kojima et al. | |
| 6,039,444 | A | 3/2000 | Mori et al. | |
| 6,403,202 | B2 | 6/2002 | Gu et al. | |
| 6,589,636 | B2 | 7/2003 | Emslander et al. | |
| 6,793,859 | B2 | 9/2004 | Emslander et al. | |
| 6,793,860 | B2 | 9/2004 | Xing et al. | |
| 6,800,341 | B2 | 10/2004 | Emslander et al. | |
| 7,056,562 | B2 | 6/2006 | Kapusniak et al. | |
| 7,087,275 | B2 * | 8/2006 | Baker et al. | 428/32.27 |
| 2001/0014382 | A1 | 8/2001 | Gu et al. | |
| 2002/0001697 | A1 | 1/2002 | Xing et al. | |
| 2003/0107635 | A1 | 6/2003 | Kinning et al. | |
| 2003/0203135 | A1 | 10/2003 | Emslander et al. | |
| 2003/0207025 | A1 | 11/2003 | Emslander et al. | |

FOREIGN PATENT DOCUMENTS

| | | | | |
|---|---|---|---|---|
| EP | 1018438 | B1 | | 3/2004 |
| EP | 0996548 | B1 | | 12/2004 |
| EP | 1417102 | B1 | | 9/2005 |
| EP | 1399317 | B1 | | 1/2006 |
| JP | 11-198522 | | | 7/1999 |
| JP | 2001-019820 | | | 1/2001 |
| JP | 2001-287450 | A | | 10/2001 |
| JP | 2002-067484 | | * | 3/2002 |
| JP | 2004-025534 | | * | 1/2004 |
| JP | 2004-345332 | | | 12/2004 |
| KR | 10-2004-0054207 | A | | 6/2004 |
| WO | WO 03/002352 | A1 | | 1/2003 |
| WO | WO 03/016068 | A1 | | 2/2003 |
| WO | WO 03-059638 | A1 | | 7/2003 |

OTHER PUBLICATIONS

Bezigian, T., "Extrusion coating technology: resin coated papers for ink jet applications"; Conference Proceedings; 2002; USA (Abstract Only).

* cited by examiner

*Primary Examiner* — Bruce H Hess

(57) ABSTRACT

An image recording medium has a substrate having a hot melt extruded ink-receiving layer formed on a first side of the substrate. The ink-receiving layer includes at least 50% of a hydrogel by weight. The hydrogel is capable of absorbing at least 50% of its dry weight of water.

14 Claims, 5 Drawing Sheets

INKJET RECORDING MEDIUM

BACKGROUND

In many print applications special media are used to provide improved image clarity, colors and durability over generic media. Often these media include special layers applied to raw base paper to achieve these improvements.

For example, photographic inkjet media belonging to conventional silver halide photographic quality generally include a photo base of resin-coated raw base paper. The resin is applied to the raw base paper by hot melt extrusion. In hot melt extrusion one or more polymeric materials are heated to or above their melting point and applied in a uniform coating on the raw base paper.

An ink-receiving layer together with other functional layers is deposited on top of the photo base by a wet coating process. In the wet coating process, a uniform and continuous wet film must be applied to the photo base. Then water or solvent must be removed from the coating by the drying process.

Energy and time requirements, in addition to technical complexity, often make the wet coating process very costly. Furthermore, the wet coating process may introduce more product defects than other aspects of the media fabrication process.

SUMMARY

An image recording medium has a substrate having a hot melt extruded ink-receiving layer formed on a first side of the substrate. The ink-receiving layer includes at least 50% of a hydrogel by weight. The hydrogel is capable of absorbing at least 50% of its dry weight of water.

A printing system includes an ink dispensing apparatus and an image recording medium. The image recording medium has a hot melt extruded ink-receiving layer formed on a first side of a substrate. The ink-receiving layer includes at least 50% by weight of a hydrogel capable of absorbing at least 50% of its dry weight of water. The ink dispensing apparatus is configured to dispense liquid ink on the ink-receiving layer of the image recording medium.

A method of fabricating an image recording medium includes providing a substrate and extruding an ink-receiving layer of a first side of the substrate. The ink-receiving layer includes at least 50% by weight of a hydrogel capable of absorbing at least 50% of its dry weight of water.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

Figure 1:
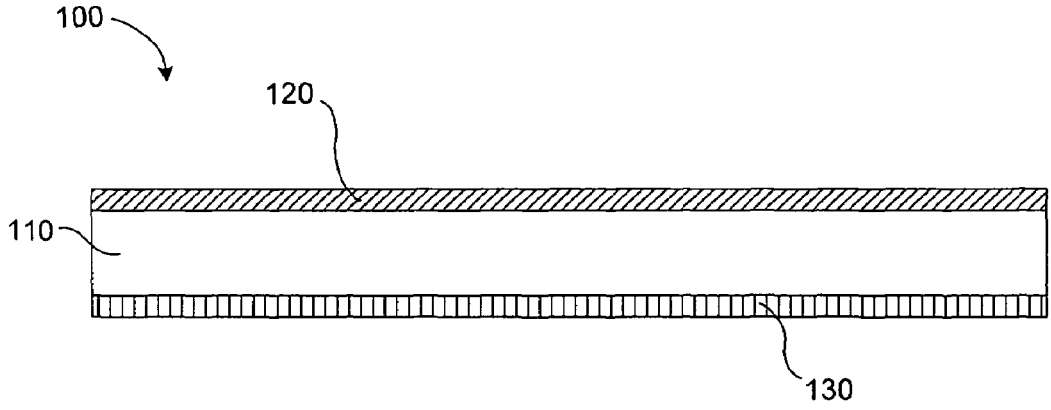
FIG. 1 is a cross-sectional side view of an exemplary embodiment of an image recording medium, according to principles described herein.

The present specification describes exemplary apparatus, systems, and methods relating to new image recording media having hot melt extruded ink receiving layers and their fabrication and use.

Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a percentage by weight range of approximately 1% to about 20% should be interpreted to include not only the explicitly recited percentage limits of 1% to about 20%, but also to include individual percentages such as 2%, 3%, 4%, and sub-ranges such as 5% to 15%, 10% to 20%, etc.

As used in the present specification and the appended claims, the term "hydrogel" refers to a moisture absorbing material such as a network of water-soluble polymer chains, an absorbent salt, or other material. The term hydrogel may also refer to a mixture of substances of which such an absorbent material is the dominant component.

As used in the present specification and the appended claims, the terms "extrude," "hot melt extrusion," and their derivatives refer to a coating process wherein a substance is heated to a temperature at or above its melting point and deposited on a moving substrate at a substantially uniform coating thickness. Examples of materials extrusible by this process include, but are not limited to, plastics, adhesives, hydrogels, and other polymeric materials.

As used in the present specification and the appended claims, the term "total moisture uptake capacity" of a deposited material is defined as the characteristic moisture absorption percentage of the material multiplied by the coat weight of the deposited material.

In the following description, for purposes of explanation, numerous specific details are set forth in order to provide a thorough understanding of the present systems and methods. It will be apparent, however, to one skilled in the art that the present systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

The present description provides an image recording medium configured to record a liquid ink image and may be used. The image recording medium comprises an ink-receiving layer for receiving the liquid ink, such as from an inkjet printer. Unlike much prior art media, however, the media of the present description do not require a wet-coating process to apply the ink-receiving layer. Rather, the image recording media utilize hot melt extruded thermoplastic hydrogel materials to create the ink-receiving layers.

Extrusible hydrogel ink-receiving layers provide several benefits in ink-receiving layers over those created with a wet coating method. The lower cost extrusion process provides a less expensive approach to media fabrication. Additionally, in applications where other layers such as resin layers are extruded onto the media, the ink-receiving layer may be coextruded with those layers and thus increase time and equipment efficiency in the manufacturing process.

Hot melt extrusion is inherently more reliable in providing a quality coating than wet coating methods, and ink-receiving layers manufactured on image recording media by the hot melt extrusion of hydrogels tend to form more continuous and uniform films than those manufactured by wet coating processes.

The use of highly absorptive, extrusible hydrogels as the main component of ink-receiving layers as presented herein provides many benefits. Extrusible hydrogels are relatively inexpensive and may be extruded onto substrates such as paper with relative ease using commercially available equipment. Additionally ink-receiving layers produced by thermoplastic hydrogels may provide as good or better image and color performance as ink-receiving layers produced by the wet coating process. Additionally, ink-receiving layers comprising thermoplastic hydrogels may have better dry time performance.

Exemplary embodiments of image recording media, printing systems, and methods according to these principles will now be discussed.

Exemplary Embodiments

Referring now to FIG. 1, an exemplary embodiment of an image recording medium (100) is a photographic inkjet medium comprising a substrate (110) of raw base paper. In other embodiments possible substrates (110) may comprise uncoated plain paper, coated paper, resin extruded paper, film, textiles, cardstock, semiconductors, and combinations thereof.

The image recording medium (100) further comprises a hot melt extruded ink-receiving layer (120) formed on a first side of the substrate (110). The ink-receiving layer comprises at least 50% of a hydrogel by weight. The hydrogel is capable of absorbing at least 50% of its dry weight of water. As such, the ink-receiving layer (120) shown here is configured to absorb aqueous inks into the hydrogel. As the ink-receiving layer (120) may comprise one or more materials that are substantially transparent at the layer thickness, when ink is absorbed by the hydrogel in the ink-receiving layer (120) the pigment or dye in the aqueous ink may remain substantially visible.

In many embodiments, the hydrogel may be an aliphatic thermoplastic polyurethane. Many grades of aliphatic thermoplastic polyurethanes are available commercially. One particular thermoplastic polyurethane that may be used in the fabrication of the ink-receiving layer (120) is Tecophilic® thermoplastic polyurethane, part of the Estane® product line available from Noveon, Inc.

Variations are made by manufacturers to the chemical ratios between functional groups in the polyurethane backbone that affect properties such as hardness/softness, water absorption capacity, water absorption rate, extrusability, and strength of these hydrogels. A grade of aliphatic thermoplastic polyurethane may be selected according to these properties and the specifications of individual printing applications. Different grades of thermoplastic polyurethane have been tested by the inventors and have been shown to absorb between about 100% and about 900% of their dry weight of water. Other grades of thermoplastic polyurethane capable of absorbing more than 1000% of their dry weight of water are available commercially.

The ink-receiving layer (120) of the embodiment shown contains between 50-100% weight percentage of the hydrogel. The remaining 0-50% of the ink-receiving layer (120) may contain functional additives such as copolymers like polyethylene, polyvinyl alcohol, polyethylene oxide, polyacrylamides, polyolefins, cellular-based polymers, combinations thereof, and the like. Other functional additives may include materials such as silica, alumina titanium dioxide, calcium carbonate, optical brightening agents, dye fixatives, release agents, and the like for optical property enhancement and/or process improvement.

The ink-receiving layer (120) may comprise a total moisture capacity of at least 1 gram per square meter (gsm). For example if the ink-receiving layer (120) is extruded at a coat weight of 5 gsm and absorbs moisture at 50% of its dry weight, the total moisture capacity would be greater than 1 gsm. In many embodiments it may be desirable to have a total moisture capacity in the range of 3 to 15 gsm or even greater.

The ink-receiving layer (120) may be deposited on the substrate (110) in one extrusion cycle. In other embodiments the ink-receiving layer (120) may comprise more than one layer of the hydrogel material with different functional additives or amounts of functional additives coextruded to create ink-receiving layer (120). Still in other embodiments the ink-receiving layer (120) may be formed by sequentially extruding layers of the hydrogel mixture until the ink-receiving layer (120) obtains a desired thickness.

The ink-receiving layer (120) of this embodiment is swellable, meaning that as the hydrogel material absorbs an aqueous ink from the printer apparatus the ink-receiving layer (120) physically increases in volume slightly. The ink-receiving layer (120) may comprise a swellable coating structure.

The image recording medium (100) shown also comprises a second hot melt extruded hydrogel layer (130) deposited on a second side of the substrate (110). The second hydrogel layer (130) may contain substantially the same hydrogel material as the ink-receiving layer (120). However the second hydrogel layer (130) may be deposited on the substrate (110) for mainly moisture absorption and control purposes and not necessarily comprise the functional additives of the ink-receiving layer. In other embodiments the second hydrogel layer (130) may serve as an ink-receiving layer for a two-sided printable medium. In such embodiments functional additives may be included in the second hydrogel layer (130).

Figure 2:
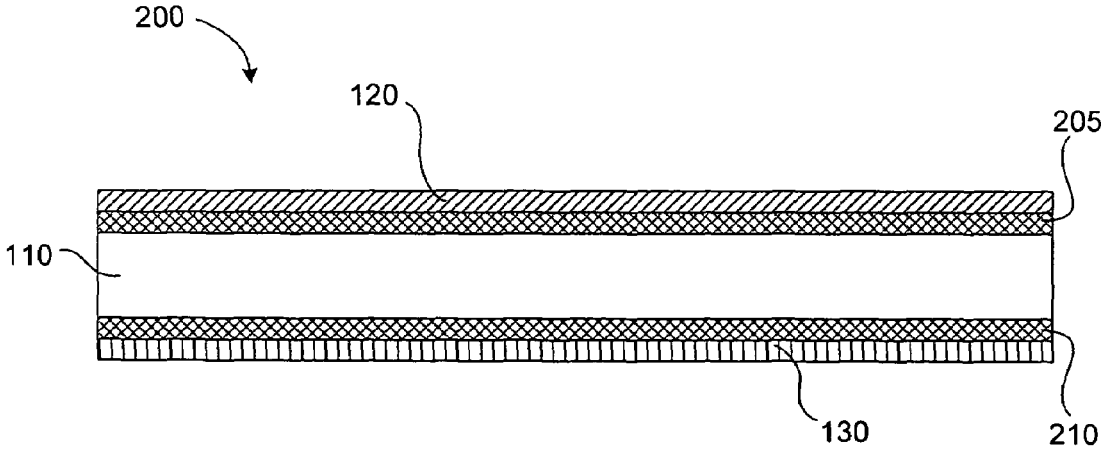
FIG. 2 is a cross-sectional side view of an exemplary embodiment of an image recording medium, according to principles described herein.

Referring now to FIG. 2, another exemplary embodiment of an image recording medium (200) may comprise a swellable ink-receiving layer (120) similar to that shown in the embodiment of FIG. 1. The image recording medium (200) also comprises a second hot melt extruded hydrogel layer (130) for curl control and other possible functions.

The image recording medium (200) shown in this figure further comprises first and second resin layers (205, 210) extruded on the substrate (110). The first resin layer (205) is intermediate the substrate (110) and the ink-receiving layer (120). The second resin layer (210) is deposited intermediate the substrate (110) and the second hydrogel layer (130).

Non-limiting examples of materials that the first and second resin layers (205, 210) may comprise include low-density polyethylene (LDPE), high-density polyethylene (HDPE), polypropylene and the like. The first and second resin layers may provide moisture barrier and/or curl control functionality to the medium (200).

Figure 3:
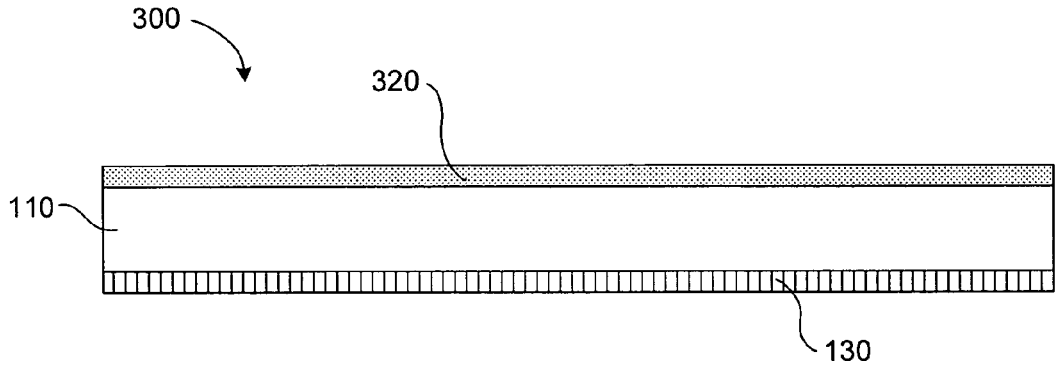
FIG. 3 is a cross-sectional side view of an exemplary embodiment of an image recording medium, according to principles described herein.

Referring now to FIG. 3, another exemplary embodiment of an image recording medium (300) according to the present disclosure comprises an ink-receiving layer (320) having a microporous structure. The ink-receiving layer (320) comprises a hydrogel with functional additives as described in relation to the embodiment of FIG. 1. The microporous structure may comprise porous pigment particulates such as silica or alumina. In this embodiment ink absorption takes place by capillary force due to micro pores. The micro-porous ink absorption process may be much faster than polymer swellable ink absorption process. The porous pigment particulates may absorb ink vehicles and function as a matting or gloss agent. The embodiment shown also comprises a second hydrogel layer (130) similar to that of previous embodiments.

In some embodiments the ink-receiving layer (320) may comprise a hydrogel already containing from 0 to 50% water or another solvent or gas. The water or other solvent or gas may be removed after the ink-receiving layer (320) is extruded, giving the ink-receiving layer (320) a porous structure. Such a structure may be advantageous in providing an ink-receiving layer with reduced swelling upon receiving ink from a printer or other ink-dispensing mechanism.

Figure 4:
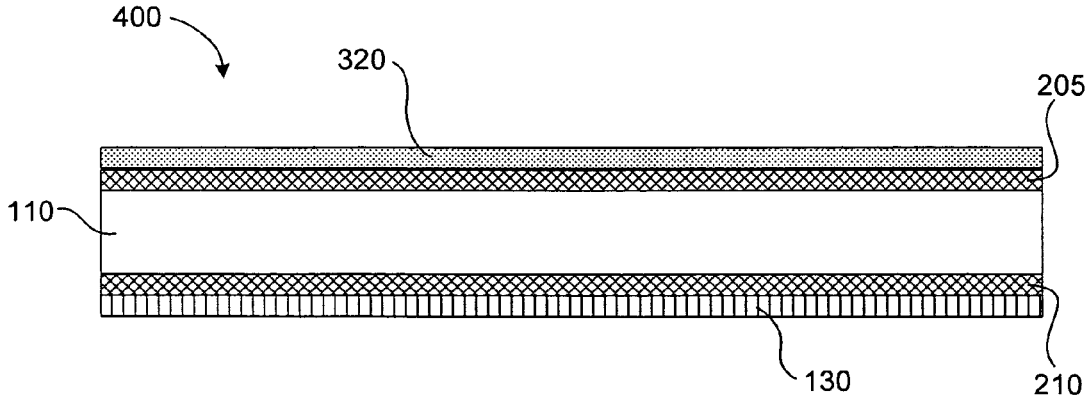
FIG. 4 is a cross-sectional side view of an exemplary embodiment of an image recording medium, according to principles described herein.

Referring now to FIG. 4, another exemplary embodiment of image recording medium (400) comprises an ink-receiving layer (320) as described in relation to the embodiment of FIG. 3. The medium (400) further comprises first and second resin layers (205, 210) similar to those described in relation to the embodiment of FIG. 2. The first resin layer (205) is extruded on a first side of the substrate (110) and is intermediate the substrate (110) and the ink-receiving layer (320). The second resin layer (210) is extruded on a second side of the substrate (110) and is intermediate the substrate (110) and second hydrogel layer (130). The first and second resin layers (205, 210) may be coextruded with the ink-receiving layer (320) and the second hydrogel layer (130), respectively.

Figure 5:
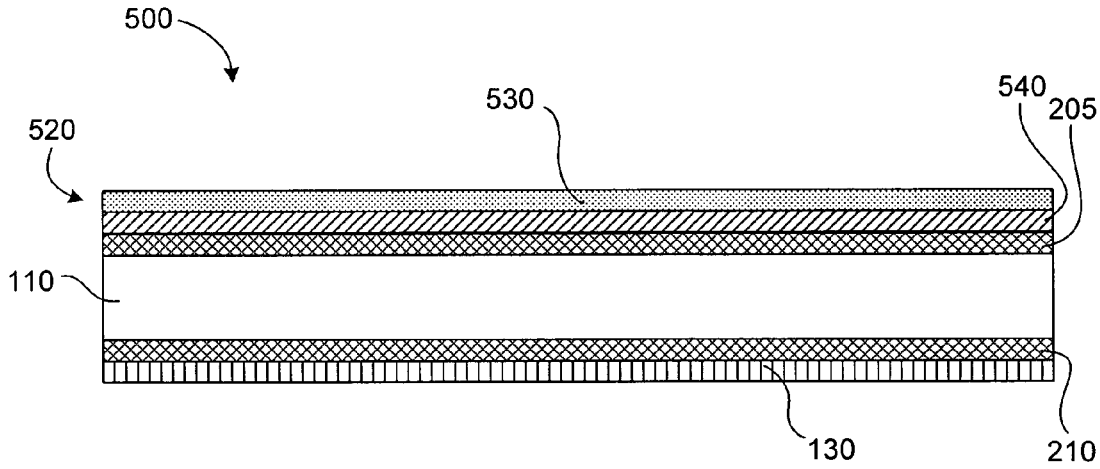
FIG. 5 is a cross-sectional side view of an exemplary embodiment of an image recording medium, according to principles described herein.

Referring now to FIG. 5, an image recording medium (500) according to the principles described herein may comprise a composite thermoplastic hydrogel ink-receiving layer (520) having a microporous layer (530) and a nonporous layer (540). The microporous layer (530) may comprise a hydrogel as previously disclosed with functional microporous additives and/or a porous structure provided by removing water or another solvent from the hydrogel after the microporous layer (530) is extruded.

The extruded nonporous layer (540) of this embodiment comprises at least 50% by weight of a thermoplastic hydrogel such as an aliphatic thermoplastic polyurethane. The thermoplastic hydrogel is capable of absorbing more than 50% of its dry weight of water. In some embodiments the thermoplastic hydrogel may be capable of absorbing more than 1000% of its dry weight of water.

The composite ink-receiving layer (520) may provide benefits inherent in both swellable and microporous types of ink-receiving layers. Both sublayers (530, 540) of the composite ink-receiving layer (520) may be coextruded onto the substrate (110). In the embodiment shown, the image recording medium (500) also comprises first and second resin layers (205, 210) for curl and/or moisture protection and a second hydrogel layer (130). The first resin layer (205) may be coextruded with the composite ink-receiving layer (520) or extruded separately. The second resin layer (210) may be coextruded with the second hydrogel layer (130). In other embodiments, the resin layers (205, 210) and second hydrogel layer (130) may not be present in the image recording medium (500).

Figure 6:
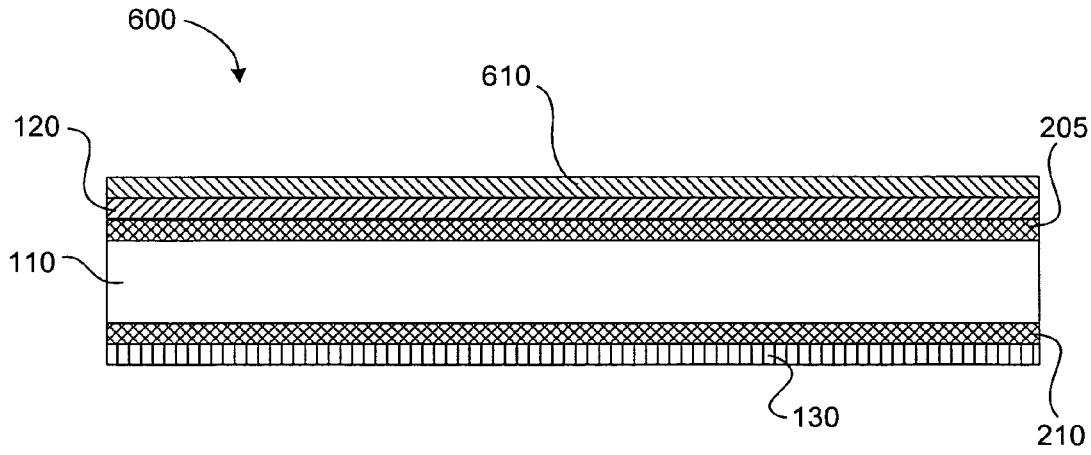
FIG. 6 is a cross-sectional side view of an exemplary embodiment of an image recording medium, according to principles described herein.

Referring now to FIG. 6, an image recording medium (600) may comprise an ink-receiving layer (120) having an extruded hydrogel, and one or more of resin, and second hydrogel layers (120, 205, 210, 130, respectively) consistent with the principles described herein in addition to at least one layer (610) applied by a subbing or wet coating process. This additional layer (610) may be an image protection or image quality enhancing layer and may be applied after the extrusion of the ink-receiving layer (120).

Figure 7:
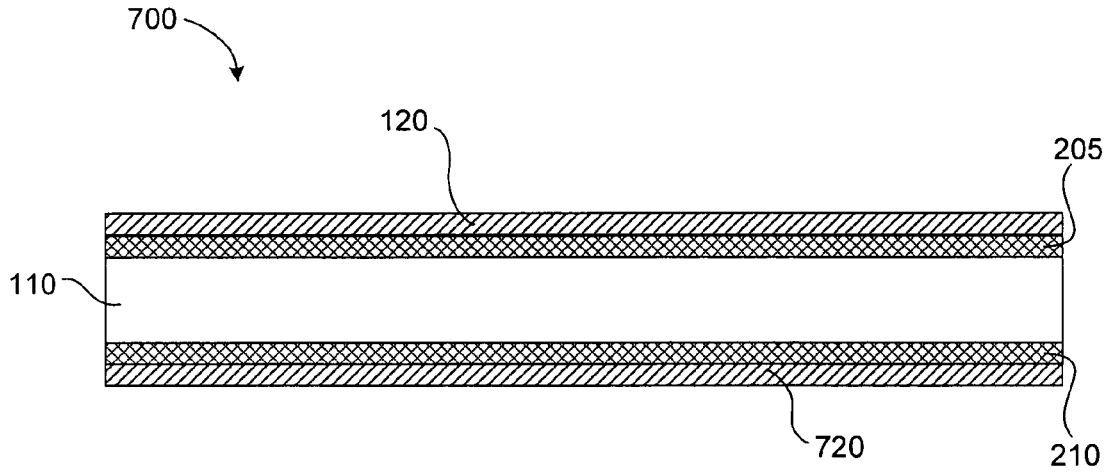
FIG. 7 is a cross-sectional side view of an exemplary embodiment of an image recording medium, according to principles described herein.

Referring now to FIG. 7, a two side image recording medium (700) may comprise a first ink-absorbing layer (120) extruded on a first side of the substrate (110) and a second ink-absorbing layer (720) extruded on a second side of the substrate (110). Both of the ink-absorbing layers (120, 720) comprise functional additives and at least 50% of a hydrogel capable of absorbing at least 50% of its weight in water, as previously described.

Exemplary Printing System

Figure 8:
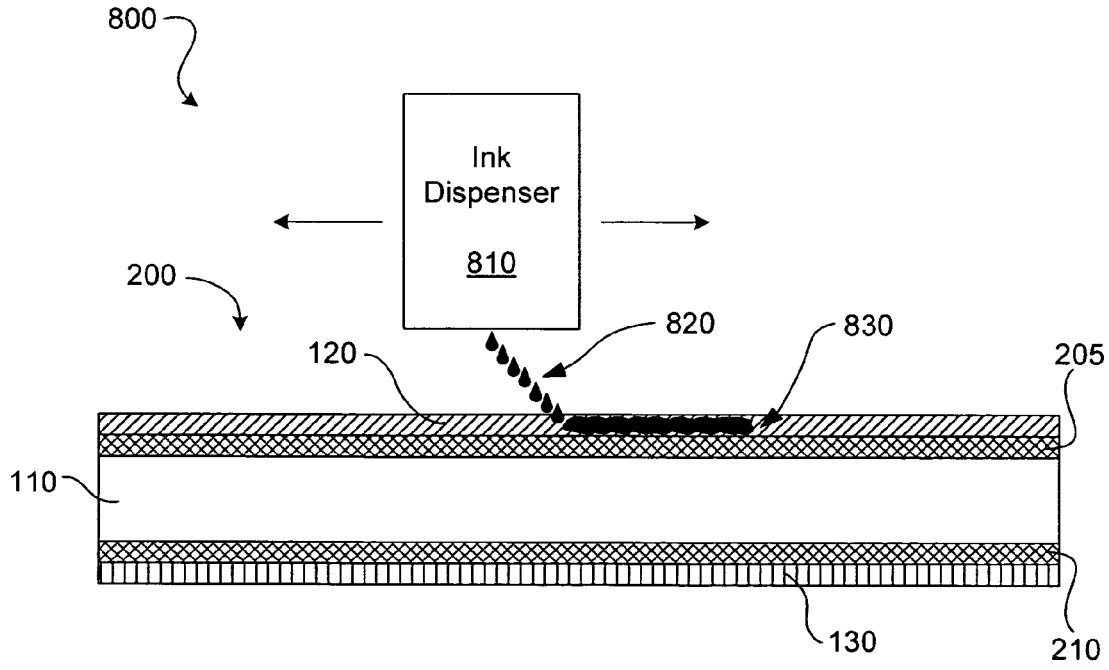
FIG. 8 is a perspective diagram of an exemplary embodiment of a printing system, according to principles described herein.

Referring now to FIG. 8, an exemplary embodiment of a printing system (800) is shown. The printing system (800) comprises an ink dispensing apparatus (810) and an image recording medium (200).

The image recording medium (200) comprises a hot melt extruded ink-receiving layer (120) formed on a first side of a substrate (110). Similar to the ink-receiving layers disclosed elsewhere in this specification, the ink-receiving layer (120) of the embodiment shown comprises at least 50% by weight of a hydrogel, the hydrogel being capable of absorbing at least 50% of its dry weight of water. The hydrogel may comprise an aliphatic thermoplastic polyurethane or another extrusible highly-absorptive hydrogel. The ink-receiving layer (120) may further comprise functional additives and have a uniform, porous, or composite structure as described in previous embodiments of image recording media.

The image recording medium (200) may further comprise a first resin layer (205) intermediate the substrate (110) and the ink-receiving layer (120) on the first side and a second resin layers (210) intermediate the substrate (110) and a second thermoplastic hydrogel layer (130) on a second side of the medium (200).

The ink dispensing apparatus (810) is configured to dispense liquid ink (820) on the ink-receiving layer (120) of the image recording medium (200). The ink-receiving layer (120) is configured to absorb the liquid ink (820) and provide an image on the medium (200) representative of that desired by a user. The aqueous ink vehicle of the absorbed ink (830) may then dry, leaving a hard and continuous ink film on the media.

The ink dispensing apparatus (810) may be an inkjet printer or component thereof. In other embodiments, the ink dispensing apparatus (810) may comprise a liquid electrolithographic apparatus or component. The ink dispensing apparatus (810) may move from side to side with respect to the medium, as indicated by the arrows, as it dispenses the liquid ink on the image recording medium (200). In other embodiments, the printing device may have fixed pens for dispensing ink and a moveable platen that holds the print media and moves the image recording medium with respect to the fixed pens. The ink dispensing apparatus (810) may further be configured to dispense two or more liquid inks of distinct colors on the ink-receiving layer (120) to provide images having primary and/or composite colors.

Exemplary Method of Fabrication

Figure 9:
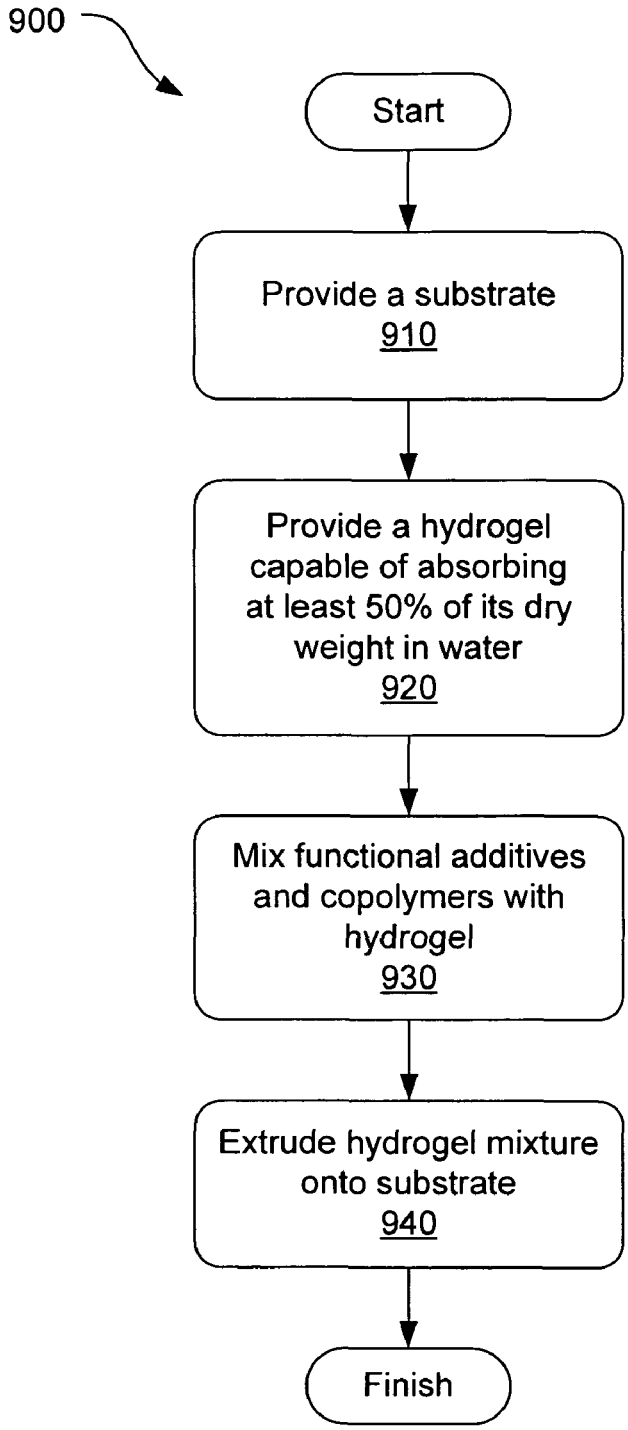
FIG. 9 is a flowchart illustrating an exemplary method of fabricating an image recording medium, according to principles described herein.

Referring now to FIG. 9, image recording media as referenced in this disclosure and claims may be fabricated using the exemplary method (900) shown. The method (900) includes the step of providing (step 910) a substrate. Non-limiting examples of possible substrates include paper, coated paper, resin extruded paper, film, textiles, cardstock, semiconductors, and combinations thereof.

Once a substrate has been provided (step 910) a hydrogel is provided (step 920), the hydrogel being capable of absorbing at least 50% of its dry weight in water. The hydrogel may be an aliphatic thermoplastic polyurethane or other thermoplastic hydrogel capable having the desired water uptake characteristics.

Functional additives may be mixed (step 930) with the hydrogel. Non-limiting examples of such functional additives include optical brightening agents, release agents, dye fixatives, fillers, porous particulates and combinations thereof. Additionally, water or another solvent may be mixed with some or all of the hydrogel to provide a porous characteristic to some or all of the ink-receiving layer.

The hydrogel mixture is then extruded (step 940) onto the substrate. Preferably the hydrogel is extruded using a hot melt extruder, an apparatus commonly known in the art. In some embodiments a resin layer may be present on the substrate before the ink-receiving layer is extruded (step 940). In other embodiments no resin layer may be deposited on the substrate at all, or the resin layer may be coextruded onto the substrate with the ink-receiving layer.

The ink-receiving layer may be porous or nonporous. In some embodiments the ink-receiving layer may comprise porous and nonporous sublayers. These sublayers may be coextruded together or extruded sequentially onto the substrate. The ink-receiving layer may comprise a coat weight between 5 and 50 grams per square meter (gsm). The ink-receiving layer may comprise a total moisture uptake capacity of greater than 1 gsm. In many embodiments the ink-receiving layer may comprise a moisture uptake capacity between 1 and 25 gsm, or even higher.

In some embodiments a top coating may be deposited on top of the ink-receiving layer. The top coating may comprise organic or inorganic coating components and may be, for example, an image protective coating, and image enhancing coating, or a combination thereof. The top coating may be applied to the image recording medium by a subbing or wet coating process, as are known in the art. The top coating may comprise a coat weight between 0.1 and 20 gsm.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. An image recording medium comprising:

a substrate;

a first hot melt extruded ink-receiving layer formed on a first side of said substrate, said ink-receiving layer comprising at least 50% of a hydrogel by weight, said first ink-receiving layer comprises at least one functional additive in addition to said hydrogel; and a second hot melt extruded ink-receiving layer formed on said first ink-receiving layer, said second ink-receiving layer comprising a hydrogel and at least one functional additive different from said at least one functional additive of said first ink-receiving layer.

2. The image recording medium of claim 1, wherein said hydrogel comprises a thermoplastic polyurethane polymer.

3. The image recording medium of claim 1, wherein said hydrogel is capable of absorbing between 50% and 1000% of its dry weight of water.

4. The image recording medium of claim 1, wherein said ink-receiving layer comprises a total moisture uptake capacity of at least 1 gsm.

5. The image recording medium of claim 1, wherein said ink-receiving layers comprises a total moisture uptake capacity between 1 and 25 gsm.

6. The image recording medium of claim 1, wherein said ink-receiving layers comprise additional copolymers.

7. The image recording medium of claim 1, wherein said ink-receiving layer further comprises functional additives.

8. The image recording medium of claim 1, wherein said functional additives are selected from the group of optical brightening agents, release agents, dye fixatives, fillers, porous particulates, image quality enhancing additives and combinations thereof.

9. The image recording medium of claim 1, wherein said substrate is selected from the group consisting of uncoated plain paper, coated paper, resin extruded paper, film, textiles, cardstocks, semiconductors, plastics, foils, and combinations thereof.

10. The image recording medium of claim 1, wherein at least one of said ink-receiving layers comprise microporous particulates.

11. The image recording medium of claim 1, wherein said ink-receiving layers comprise a porous layer and a substantially nonporous portion layer, wherein said porous layer absorbs liquid by capillary force.

12. The image recording medium of claim 1, further comprising at least one extruded polymer layer formed on a second side of said substrate.

13. The image recording medium of claim 12, wherein said extruded polymer layer formed on said second side of said substrate does not include any of said functional additives.

14. The image recording medium of claim 1, further comprising an image quality enhancing or protection layer formed over at least one side of the substrate.

* * * * *

UNITED STATES PATENT AND TRADEMARK OFFICE

CERTIFICATE OF CORRECTION

PATENT NO. : 7,935,398 B2
APPLICATION NO. : 11/650377
DATED : May 3, 2011
INVENTOR(S) : Chang Park et al.

It is certified that error appears in the above-identified patent and that said Letters Patent is hereby corrected as shown below:

In column 8, line 46, in Claim 11, after “nonporous” delete “portion”.

Signed and Sealed this
Eleventh Day of October, 2011

David J. Kappos

David J. Kappos
*Director of the United States Patent and Trademark Office*